US010746001B2

(12) United States Patent
Liew et al.

(10) Patent No.: US 10,746,001 B2
(45) Date of Patent: Aug. 18, 2020

(54) CASED BORE TUBULAR DRILLING AND COMPLETION SYSTEM AND METHOD

(71) Applicant: GE Oil & Gas Pressure Control LP, Houston, TX (US)

(72) Inventors: Joseph Shu Yian Liew, Singapore (SG); Hoong Man Ng, Singapore (SG)

(73) Assignee: GE OIL & GAS PRESSURE CONTROL LP, Houston, TX (US)

( * ) Notice: Subject to any disclaimer, the term of this patent is extended or adjusted under 35 U.S.C. 154(b) by 208 days.

(21) Appl. No.: 15/885,389

(22) Filed: Jan. 31, 2018

(65) Prior Publication Data

US 2019/0234187 A1 Aug. 1, 2019

(51) Int. Cl.

| | |
|---|---|
| ***E21B 43/10*** | (2006.01) |
| ***E21B 33/128*** | (2006.01) |
| ***E21B 33/129*** | (2006.01) |

(52) U.S. Cl.

CPC ..... *E21B 43/10* (2013.01); *E21B 33/128* (2013.01); *E21B 33/129* (2013.01)

(58) Field of Classification Search

CPC ..... E21B 33/12955; E21B 33/1295; E21B 33/04; E21B 33/129; E21B 33/1291; E21B 33/1292; E21B 33/0422; E21B 33/128; E21B 33/1285; E21B 19/10; E21B 43/10

See application file for complete search history.

(56) References Cited

U.S. PATENT DOCUMENTS

| | | | | |
|---|---|---|---|---|
| 2,901,046 | A | 8/1959 | Webber | |
| 3,211,227 | A | 10/1965 | Mott | |
| 4,396,066 | A | 8/1983 | Akkerman | |
| 4,561,499 | A | 12/1985 | Berner, Jr. | |
| 5,180,016 | A | 1/1993 | Ross | |
| 5,253,705 | A * | 10/1993 | Clary | E21B 23/02 166/123 |
| 7,096,656 | B2 | 8/2006 | Reimert | |
| 7,350,583 | B2 | 4/2008 | Nguyen | |
| 7,419,001 | B2 | 9/2008 | Broussard | |
| 9,689,252 | B2 | 6/2017 | Ringgenberg | |
| 2012/0160522 | A1 | 6/2012 | Burgos | |

OTHER PUBLICATIONS

"Casing, tubing strings locked into wellhead with friction grip device," Jan. 5, 2000, Offshore, 8 pages.

International Search Report and Written Opinion dated Apr. 8, 2019 in corresponding PCT Application No. PCT/US2019/016024.

* cited by examiner

*Primary Examiner* — George S Gray

(74) *Attorney, Agent, or Firm* — Hogan Lovells US LLP

(57) ABSTRACT

A system includes a pair of wellbore tubulars coupled together via a casing collar. A hold down collar is arranged circumferentially about the casing collar. An actuating piston of the system includes an actuating body, the actuating piston being axially movable along the wellbore axis between an activated position and a deactivated position. Slip elements are arranged downstream of the actuating piston, the slip elements receiving the actuating body in a space formed between the slip elements, wherein the actuating body drives the respective slip elements in opposite radial directions when in the activated position to secure the wellbore tubulars within the wellbore.

14 Claims, 9 Drawing Sheets

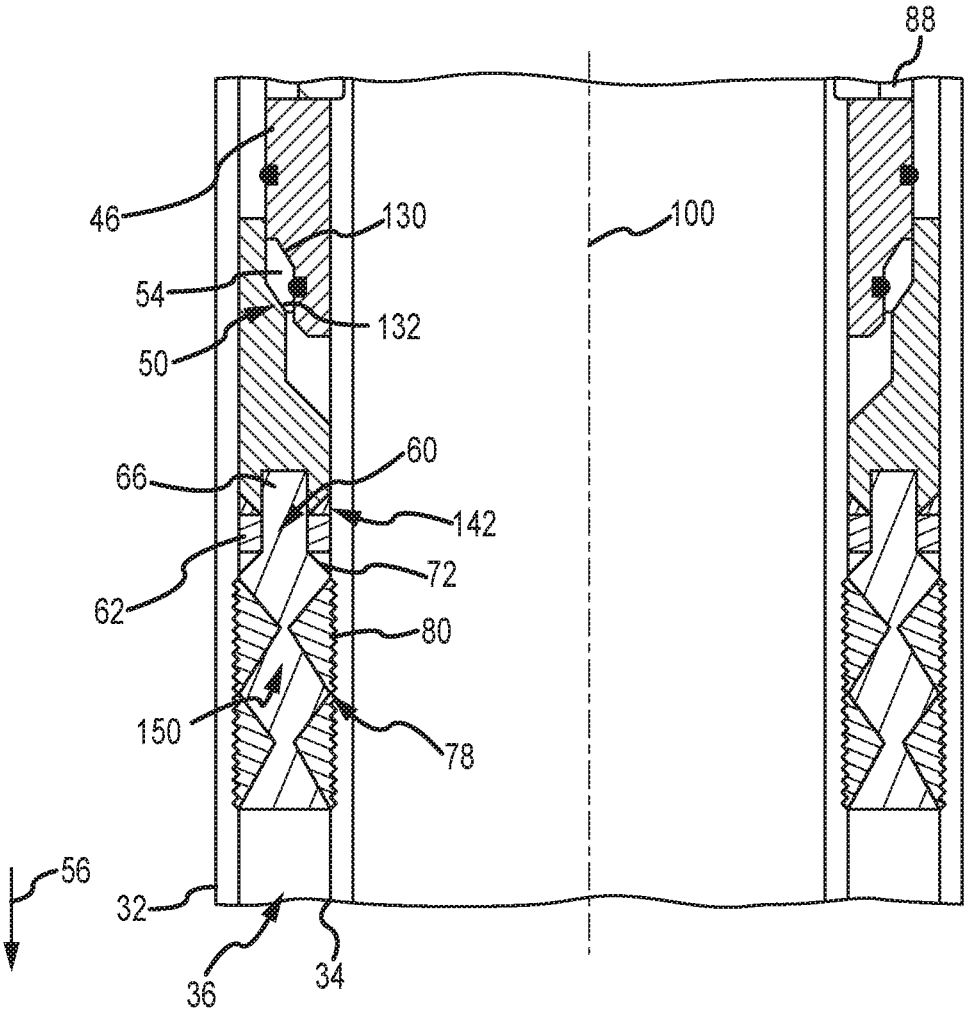
FIG.6
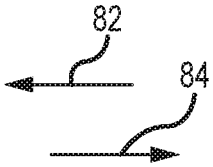

CASED BORE TUBULAR DRILLING AND COMPLETION SYSTEM AND METHOD

BACKGROUND

1. Field of the Invention

The present disclosure relates in general to downhole drilling and more particularly to cased bore tubular drilling systems and methods.

2. Description of Related Art

During well site operations, such as oil and gas exploration, various wellbore tubulars (e.g., piping components) may be lowered into a wellbore formed in a ground formation. Traditionally, these tubulars are hung or suspended from equipment at the surface via hangers having one or more load shoulders for supporting the weight of the tubulars. The hangers may be part of a surface wellhead system, offshore drilling system, or subsea system that may be costly to install and maintain at the well site. Consequently, the cost of the hanger systems may be prohibitively expensive for exploratory drilling operations. As a result, potentially recoverable reserves may not be utilized to their full potential.

SUMMARY

Applicants recognized the problems noted above herein and conceived and developed embodiments of systems and methods, according to the present disclosure, for downhole tubular systems.

In an embodiment a system for positioning a tubular component within a wellbore includes a pair of wellbore tubulars coupled together via a casing collar, the wellbore tubulars having a longitudinal axis substantially aligned with a wellbore axis. The system also includes a hold down collar arranged circumferentially about the casing collar, the hold down collar securing the casing collar to the wellbore tubulars. The system further includes an actuating piston including an actuating body, the actuating piston being axially movable along the wellbore axis between an activated position and a deactivated position, the actuating body moving along with the actuating piston. The system also includes slip elements arranged downstream of the actuating piston, the slip elements receiving the actuating body in a space formed between the slip elements, wherein the actuating body drives the respective slip elements in opposite radial directions when in the activated position to secure the wellbore tubulars within the wellbore.

In another embodiment a system for hanging a wellbore tubular within a wellbore includes a first segment of casing tubular. The system also includes a second segment of casing tubular, the second segment coupled to the first segment via a casing collar. The system includes a hold down collar arranged circumferentially about the casing collar and securing the first segment to the second segment, the hold down collar extending radially outward from the first and second segments. The system further includes an upper nut abutting a lower shoulder formed by the casing collar and being coupled to at least one of the casing collar and the hold down collar. The system also includes an actuating piston positioned proximate of the upper nut, wherein at least a portion of the actuating piston is radially outward of the upper nut, and the actuating piston is moveable along a longitudinal axis of the wellbore relative to the upper nut. The system includes an actuating body positioned within an opening in the actuating piston, wherein the actuating body is coupled to the actuating piston such that movement of the actuating piston is transferred to the actuating body. The system also includes slip elements positioned downhole of the actuating piston, wherein movement of the actuating piston transitions the slip elements from a deactivated position to an activated position where the slip elements move radially from one another in opposite directions.

In an embodiment a method for installing a wellbore tubular in a wellbore includes coupling a first casing tubular to a second casing tubular via a casing collar. The method also includes securing the first casing tubular to the second casing tubular via a hold down collar. The method further includes securing an activation system to at least one of the casing collar and the hold down collar. The method also includes positioning the first and second casing tubulars within the wellbore. The method further includes transitioning the activation system from a deactivated position to an activated position.

BRIEF DESCRIPTION OF DRAWINGS

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

FIG. 6 is a partial detailed schematic cross-sectional view of an embodiment of a CBTDCS, in accordance with embodiments of the present disclosure;

DETAILED DESCRIPTION

Figure 1:
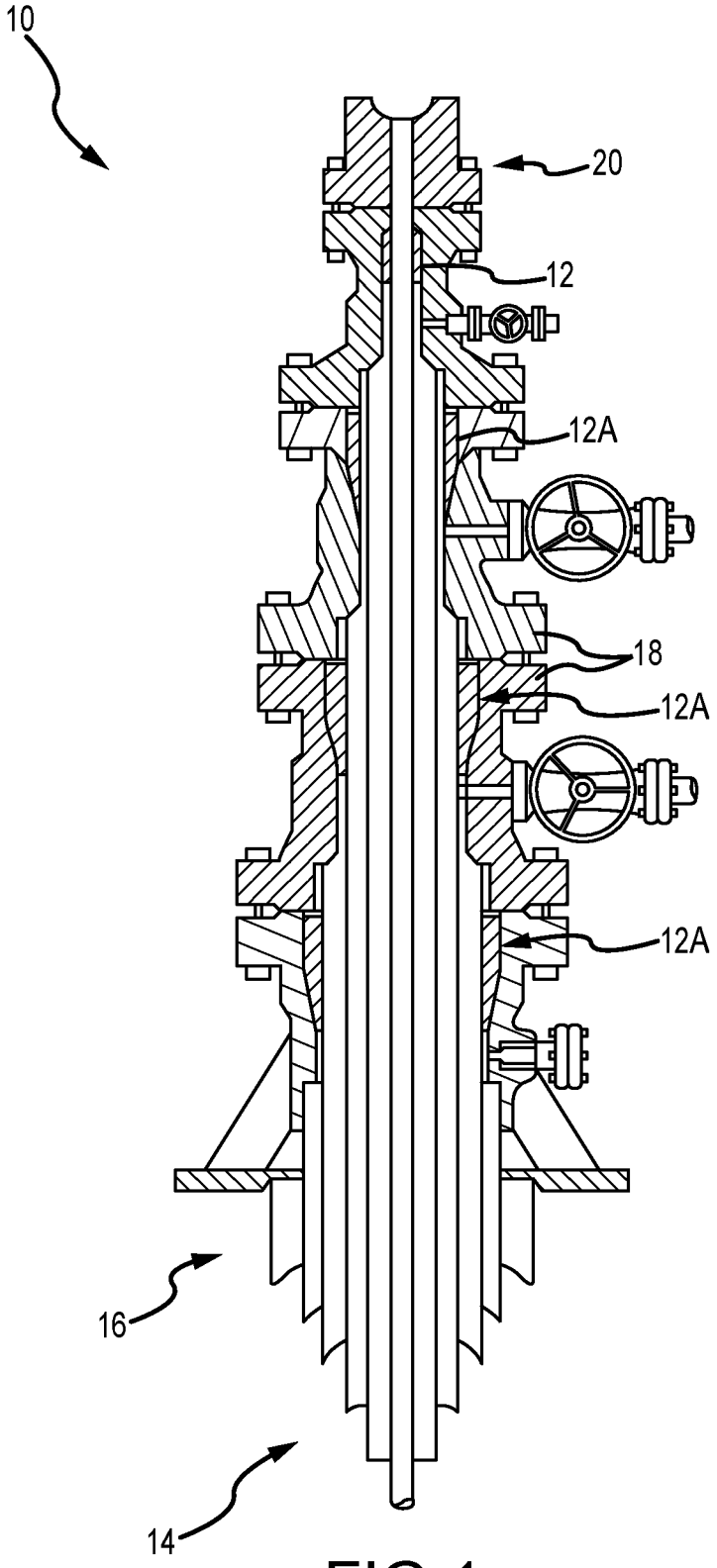
FIG.1 (PRIOR ART)
FIG. 1 is a schematic cross-sectional view of an embodiment of a wellhead system, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions.

Embodiments of the present disclosure include a cased bore tubular drilling and completion system (CBTDCS) for use in downhole drilling operations. In various embodiments, the CBTDCS enables one or more wellbore components to be suspended from a location within an inner diameter of a wellbore without hanging the components from surface equipment, such as a casing or tubing hanger. For example, the CBTDCS may include one or more actuatable slip elements that engage an inner diameter of the wellbore, which may be cased, and an outer diameter of a wellbore tubular, such as casing. Accordingly, components may be suspended within the wellbore with increased flexibility and reduced costs, thereby enabling additional exploratory wells and/or more wells at a given site. In various embodiments, the CBTDCS includes an actuating piston that is driven into an engaged position via a fluid pressure introduced into an annulus of the wellbore. The fluid pressure may enter a void space via a flow line coupled to a one-way valve. The valve may block the fluid from exiting the void space until a predetermined condition, such as a certain pressure condition, is reached. As a result, the CBTDCS may remain in an activated position until a certain condition is met. In various embodiments, the CBTDCS further includes a sealing element that may be compressed and loaded within the annulus of the wellbore. This seal may block fluid and/or gas from moving uphole (e.g., in an upward direction) past the CBTDCS. Upon completion of operations, the CBTDCS may be removed from the wellbore by applying a pressure exceeding the capacity of the rupture disk or similar device. This will result in the rupture disk bursting and releasing the fluid from the void space. Thereafter, the CBTDCS may be removed from the wellbore via application of an upward force.

In various embodiments, the CBTDCS may be utilized in a variety of configurations, such as with surface wellhead equipment, offshore applications, subsea completion systems, mudline suspension systems, drilling systems, and the like. The CBTDCS enables suspension of tubular strings without a fixed landing point, thereby improving flexibility of operations. Furthermore, various components associated with conventional wellhead equipment may be eliminated by utilizing the CBTDCS. In various embodiments, the CBTDCS is actuated using annular pressure, and as a result control lines and the like may not be utilized. The system further may be activated in a single operation. As will be described in detail below, pressurizing the annulus may deploy the actuating piston to activate the slip elements, which seals and grips an outer casing inner diameter to an interior casing outer diameter. The system further reduces capital expenditures due to the replacement or elimination of conventional wellhead equipment. Furthermore, the reduced number of parts may produce more efficient operations and reduced operating expenditures.

FIG. 1 is a schematic cross-sectional side elevational view of an embodiment of a prior art wellhead system 10 including a tubing hanger 12 and casing hangers 12A for supporting downhole tubulars 14 that extend into a wellbore 16. In the illustrated embodiment, the tubulars 14 may include production tubing, production casing, or the like. In the illustrated prior art wellhead system 10, a casing head 18 is arranged proximate the surface and further includes a Christmas tree 20 coupled to the tubing hanger 12. It should be appreciated that various components of the system have been eliminated for clarity with the present discussion, and moreover, additional components may be incorporated into the wellhead system 10, such as blow out preventers, fracing manifolds, and the like. As shown, the wellhead system 10 depends on equipment that is suspended at a fixed location, namely the tubing hanger 12 and casing hangers 12A. Accordingly, in order to drill exploration wells, expensive wellhead systems 10 are installed and utilized throughout wellbore operations. Operators may be hesitant to drill exploration wells with high costs due to the risks, and as a result formations may be unused or under-utilized.

Figure 2:
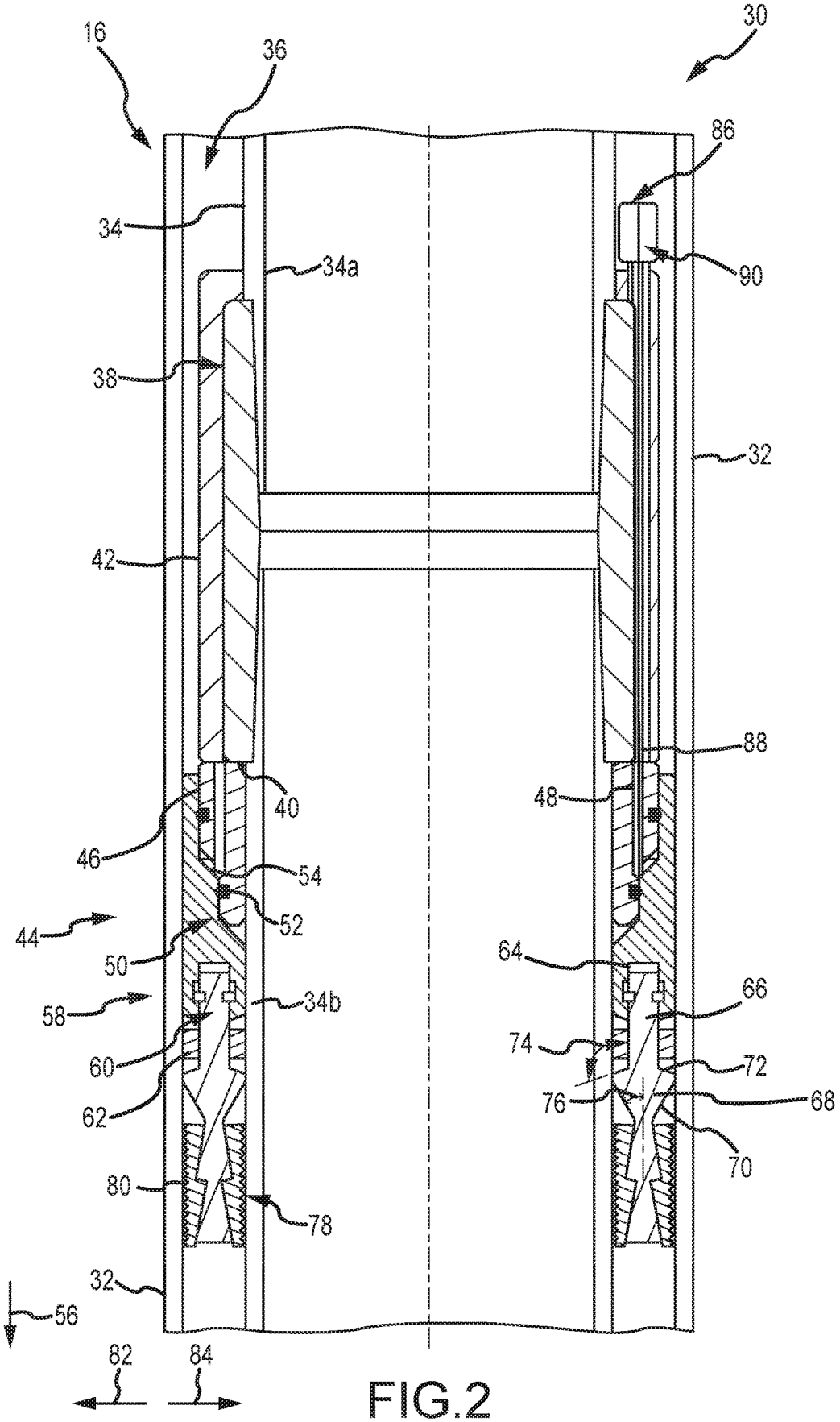
FIG. 2 is a schematic cross-sectional view of an embodiment of a cased bore tubular drilling and completion system (CBTDCS) is a disengaged position, in accordance with embodiments of the present disclosure.

Systems and methods of the present disclosure are directed toward improved completion systems that may be utilized within the inner diameter (ID) of casing to enable suspension and deployment of wellbore tubulars at different locations along a length of a wellbore. This offers flexibility for operators and also reduces costs associated with expensive wellbore equipment, such as the equipment illustrated in FIG. 1. Accordingly, embodiments of the present disclosure enable production equipment to be utilized at the surface, while suspended components are positioned in the wellbore. FIG. 2 is a schematic cross-sectional side view of an embodiment of a cased bore tubular drilling and completion system 30 (CBTDCS). The illustrated embodiment includes the wellbore 16 with casings 32 and 34. In various embodiments, casing 32 (e.g., outer casing 32) may be utilized to deploy the CBTDCS 30 due to its substantially uniform wall location and surface. That is, when drilling the wellbore 16 the general shape may not be substantially circular, due to differences in formation properties and/or adjustments during drilling operations. Embodiments described herein may include the outer casing 32 due to the advantages described above, such as the generally uniform shape and surface roughness. The illustrated embodiment includes the interior casing 34, which may be API tubular casing. In the illustrated embodiment, an annulus 36 is formed between the casing 32 and the interior casing 34. As will be described in detail below, a size of the annulus 36 may be particularly selected to receive one or more components of the CBTDCS 30.

The interior casing 34 is deployed in tubular joints and coupled together via a casing collar 38. In various embodiments, the casing collar 38 may be formed in accordance with API standards, as may other equipment described herein. As shown, the casing collar 38 is not anchored against the casing 32, and rather, extends radially outward from the interior casing 34 and into the annulus 36. In other words, the casing collar 38 may not be radially flush with the interior casing 34. The casing collar 38 may provide a shoulder 40 that is utilized during deployment of various components of the CBTDCS 30, as will be described in detail below. The illustrated casing collar 38 is restrained with a hold down collar 42. In various embodiments, the hold down collar 42 is a split ring that is arranged around the casing collar 38. Additionally, in embodiments, the hold down collar 42 may be a one-piece, continuous structure that is arranged over the casing collar 38. As illustrated, the hold down collar 42 extends radially outward from the interior casing 34 and the casing collar 38 and into the annulus 36. In various embodiments, the hold down collar 42 may form at least a portion of the shoulder 40.

The illustrated CBTDCS 30 further includes an activation system 44 for hanging the interior casing 34 from the casing 32. That is, various tubular joints of the interior casing 34*a*, 34*b* may be coupled together and suspended from the casing 32 using the CBTDCS 30. The illustrated activation system 44 includes an upper nut 46 positioned downhole from the casing collar 38. In various embodiments, the upper nut 46 is arranged proximate to and in contact with the shoulder 40. In various embodiments, the upper nut 46 may be secured to at least one of the casing collar 38 and the hold down collar 42, for example, via a fastener.

In various embodiments, the upper nut 46 includes one or more passages or ports 48 to facilitate fluid flow to areas downhole of the upper nut 46. As will be described below, fluid may be transported through the annulus 36 and the upper nut 46 to activate one or more pistons to drive seal segments into the casing 32 and the interior casing 34. The ports 48 may be coupled to hydraulic lines, as will be described below, to facilitate transport of the fluid.

The illustrated upper nut 46 is arranged proximate an actuating piston 50. In various embodiments, seals 52 extend from the upper nut 46 and rest against the actuating piston 50 to block fluid flow past the actuating piston 50. Furthermore, in various embodiments, the seals 52 may facilitate movement (e.g., vertical travel) between the actuating piston 50 and the upper nut 46 by limiting or reducing the likelihood of sticking or friction between the actuating piston 50 and the upper nut 46. Arranged between the actuating piston 50 and the upper nut 46 is a void space 54, which may extend circumferentially about the CBTDCS 30. This void space 54 receives fluid that travels through the ports 48, thereby driving movement of the actuating piston 50 in a downward direction 56.

The actuating piston 50 includes a slip carrier 58 holding an actuating body 60. In various embodiments, movement of the actuating piston 50 is transmitted to the actuating body 60, via the slip carrier 58, and therefore movement of the actuating piston 50 translates to movement of the actuating body 60. The actuating body extends through a sealing element 62 arranged in the annulus 36 between the casing 32 and the interior casing 34. As will be described in detail below, when the CBTDCS 30 is activated, the sealing element 62 is compressed by a lower portion of the actuating piston 50 and a rear portion of the actuating body 60. In various embodiments, the sealing element 62 is a metal to metal sealing element. However, in embodiments, the sealing element 62 may be a metal encapsulated bulk rubber seal, an elastomer seal, an inflatable/injectable sealing element, or the like. Furthermore, while the illustrated embodiment shows a single sealing element 62, there may be two, three, four, or any reasonable number of sealing elements. As illustrated, a gap 64 is arranged between the actuating body 60 and the actuating piston 50 that enables compression of the sealing element 62 when fully energized. As a result, the actuating piston 50 may move in the downward direction 56 until the gap 64 is almost or substantially eliminated so that the actuating piston 50 bottoms out against the sealing element 62 and not the top of the actuating body 60.

The illustrated actuating body 60 is generally arrow shaped in that it has a rear end 66 having a generally rectangular shape and a head end 68 having a generally triangular shape. As shown, the head end 68 is angled on a front face 70 and on a rear face 72, the angular direction being substantially opposite. That is, an angle 74 on the rear face 72 is generally obtuse while the angle 76 on the front face 70 is generally acute. The obtuse angle 74 on the rear face 72 facilitates compression of the sealing element 62 when the actuating body 60 is driven in the downward direction 56.

The illustrated CBTDCS 30 further includes the slip elements 78. In various embodiments, the slip elements 78 include a slip ring. However, the slip elements 78 may be slip segments in embodiments. In certain embodiments, the slip elements 78 may be metallic components that include teeth 80 that bite or cut into the casing 32 and/or the interior casing 34. Upon activation by the actuating body 60, the slip elements 78 are driven apart in first and second radial directions 82 (radially outward), 84 (radially inward) and into the inner diameter of the casing 32 and the outer diameter of the interior casing 34. As a result, the interior casing 34 is coupled to the casing 32 without suspension from above, for example from a surface component such as a wellhead system. Accordingly, the illustrated CBTDCS 30 provides improved flexibility in wellbore operations because it may be deployed along any location within the wellbore 16. Furthermore, the CBTDCS 30 may be deployed in stages along the length of the wellbore 16. As a result, costs associated with wellhead equipment may be reduced while still providing the functionality associated with vertical hanging systems.

In certain embodiments, the actuating piston 50 is driven in the downward direction 56 via a fluidic force, for example, from a blow-out preventer (BOP). For instance, the BOP may be shut and pressurized fluid may be driven into the annulus 36. A valve 86 is arranged within the annulus 36 in the illustrated embodiment to direct the fluid into a flow line 88 coupled to the upper nut 46. In various embodiments, the valve 86 further includes a relief component 90, which is a rupture disk in the illustrated embodiment. In operation, the valve 86 may be a one way valve, such as a ball check valve, that enables the fluid to flow in the downward direction 56 and into the void space 54, but blocks fluid from flowing out of the valve 86. As a result, fluid pressure is maintained within the void space 54 and therefore the actuating body 60 maintains the slip elements 78 in an engaged position where the teeth 80 contact the inner diameter of the outer casing 32 and the outer diameter of the interior casing 34. To remove the CBTDCS 30, the void space 54 and the flow line 88 may be pressurized to a point that the relief component 90 releases the pressure from the void space 54. For example, in embodiments where the relief component 90 is a rupture disk, the flow line 88 may be pressurized to a predetermined pressure that will cause the rupture disk to break and relieve the fluid pressure. Thereafter, the CBTDCS 30 may be removed from the wellbore 16.

Figure 3:
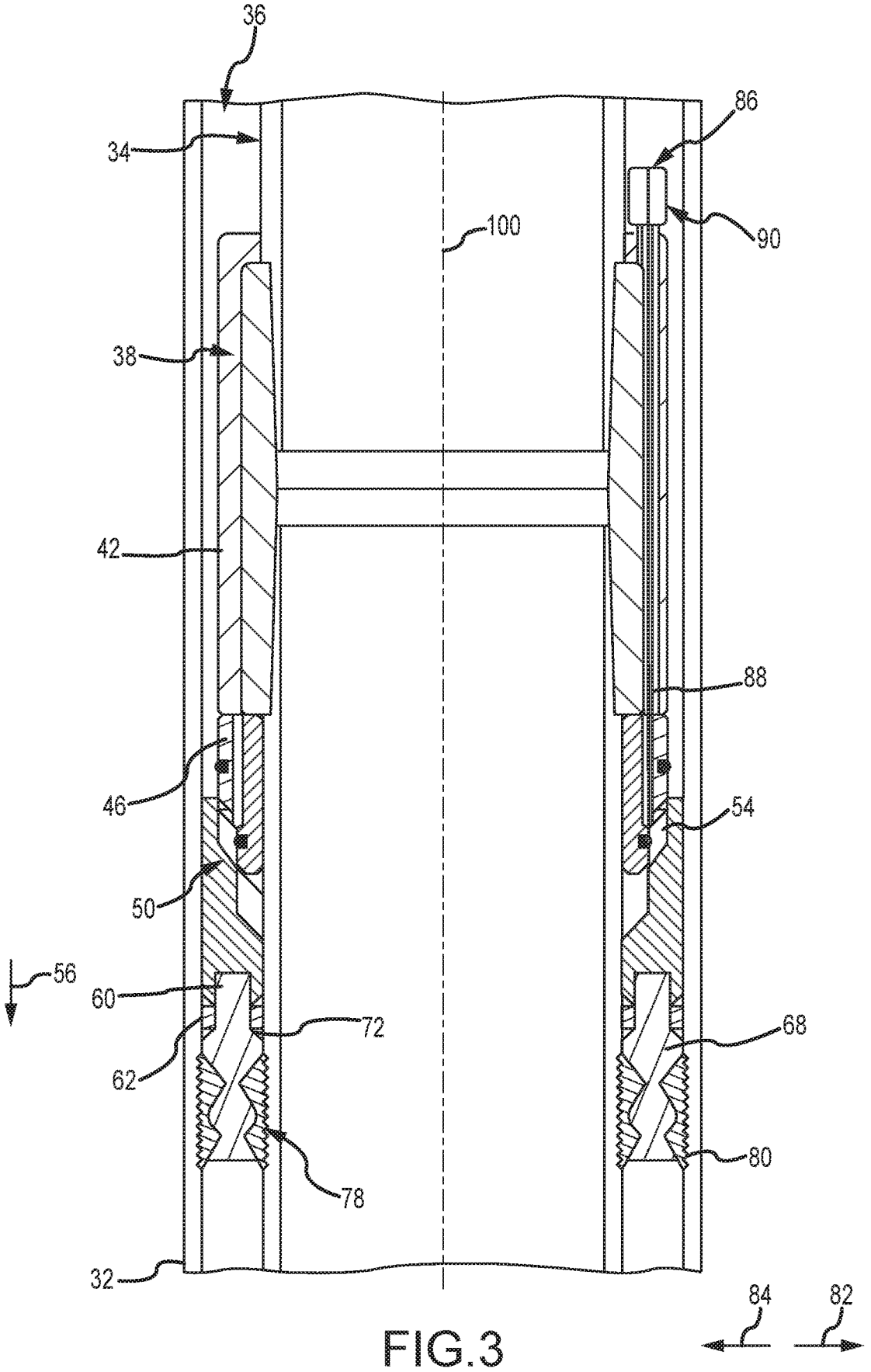
FIG. 3 is a schematic cross-sectional view of an embodiment of a CBTDCS in an engaged position, in accordance with embodiments of the present disclosure.

FIG. 3 is a schematic cross-sectional view of an embodiment of the CBTDCS 30 where the slip elements 78 are in an engaged position. As used herein, the engaged position describes a position in which the actuating body 60 has caused the slip elements 78 to move in at least one of the first and second radial directions 82, 84. In the illustrated embodiment, fluid has entered the void space 54, for example via the flow line 88, to drive the actuating piston 50 in the downward direction 56. In the illustrated embodiment, the gap 64 has been reduced due to the movement of the actuating piston 50. Moreover, the sealing element 62 is compressed between the lower portion of the actuating piston 50 and the rear face 72 of the head end 68 of the actuating body 60. Compression of the sealing element 62 loads the seal and causes the sealing element 62 to expand within the annulus 36, thereby forming a seal between the inner diameter of the outer casing 32 and the outer diameter of the interior casing 34. This seal may prevent pressurized fluids and gases from traveling through the annulus 36 and toward the surface. Furthermore, the seal may be utilized to at least partially support the interior casing 34.

Further illustrated in FIG. 3 is the expansion of the slip elements 78 into the engaged position. As the actuating body 60 is driven in the downward direction 56, the components of the slip element 78 are driven in the first and second radial directions 82, 84, thereby driving the teeth 80 into the casing 32 and interior casing 34. As a result, axial movement of the CBTDCS 30 is blocked along a longitudinal axis 100 of the wellbore 16. Accordingly, the CBTDCS 30 may be deployed for drilling and/or production operations in the wellbore 16. To initiate removal, the flow line 88 may be pressurized to a predetermined amount to activate the relief component 90. Without the fluidic pressure driving and holding the actuating body 60 in place, the CBTDCS 30 may be pulled from the wellbore 16.

Figure 4:
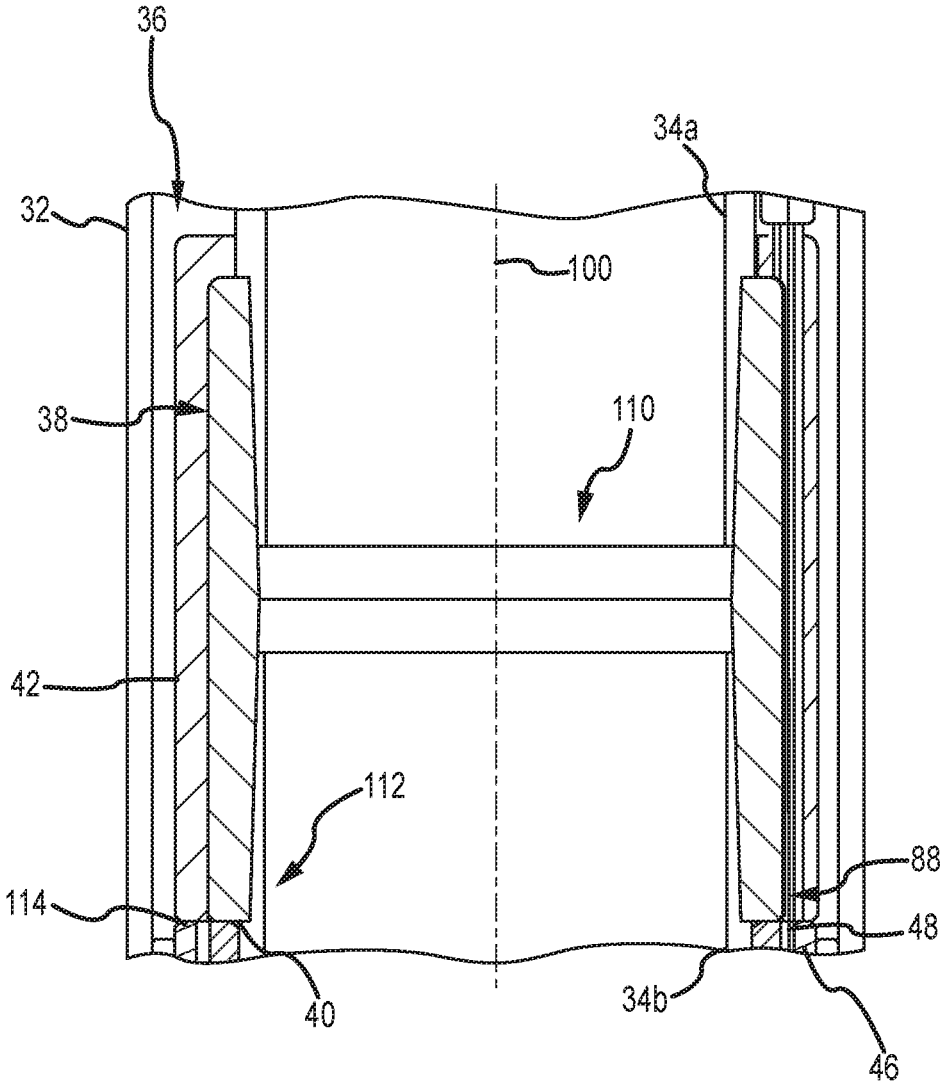
FIG. 4 is a partial detailed schematic cross-sectional view of an embodiment of a CBTDCS hold down collar coupled to a casing collar, in accordance with embodiments of the present disclosure.

FIG. 4 is a detailed partial schematic view of an embodiment of a coupling interface 110 between the respective interior casings 34*a*, 34*b*. As described above, the respective interior casings 34*a*, 34*b* are coupled together via the casing collar 38, which includes the shoulder 40 at a lower end 112 thereof. Accordingly, pressured fluid that enters the void space 54 may be utilized to drive axial movement of the actuating piston 50, but the upper nut 46 may not experience axial movement due to the shoulder 40 holding the upper nut 46 in position. As shown, the casing collar 38 extends radially outward from the axis 100 such that the casing collar 38 is arranged within the annulus 36. The illustrated embodiment further includes the hold down collar 42 circumferentially arranged about the casing collar 38. In various embodiments, the hold down collar 42 may be a single piece that is slipped over the casing collar 38, for example at the surface, or may be one or more pieces that are fastened about the casing collar 38. As illustrated, the hold down collar 42 includes an anchor 114 that couples the hold down collar 42 to the upper nut 46. In various embodiments, a fastener may extend through the anchor 114 such that the hold down collar 42 is removably coupled to the upper nut 46. In various embodiments, the above-described flow line 88 may extend through the hold down collar 42 to facilitate transportation of fluid toward the void space 54. Further in certain embodiments, the hold down collar 42 may include a notch or channel to provide a guide for the flow line 88.

The embodiment illustrated in FIG. 4 further includes the flow line 88 extending toward the port 48 arranged on the upper nut 46. The flow line 88 may be rigidly coupled to the upper nut 46, for example with one or more fittings, or flexible connections such as tubing may be utilized to facilitate transmission of the fluid to the void space 54 via the upper nut 46. In various embodiments, as described above, the flow line 88 may extend through the hold down collar 42. For example, the flow line 88 may be at least partially formed through a portion of the hold down collar 42 or be arranged within a gap or channel in the hold down collar 42.

Figure 5:
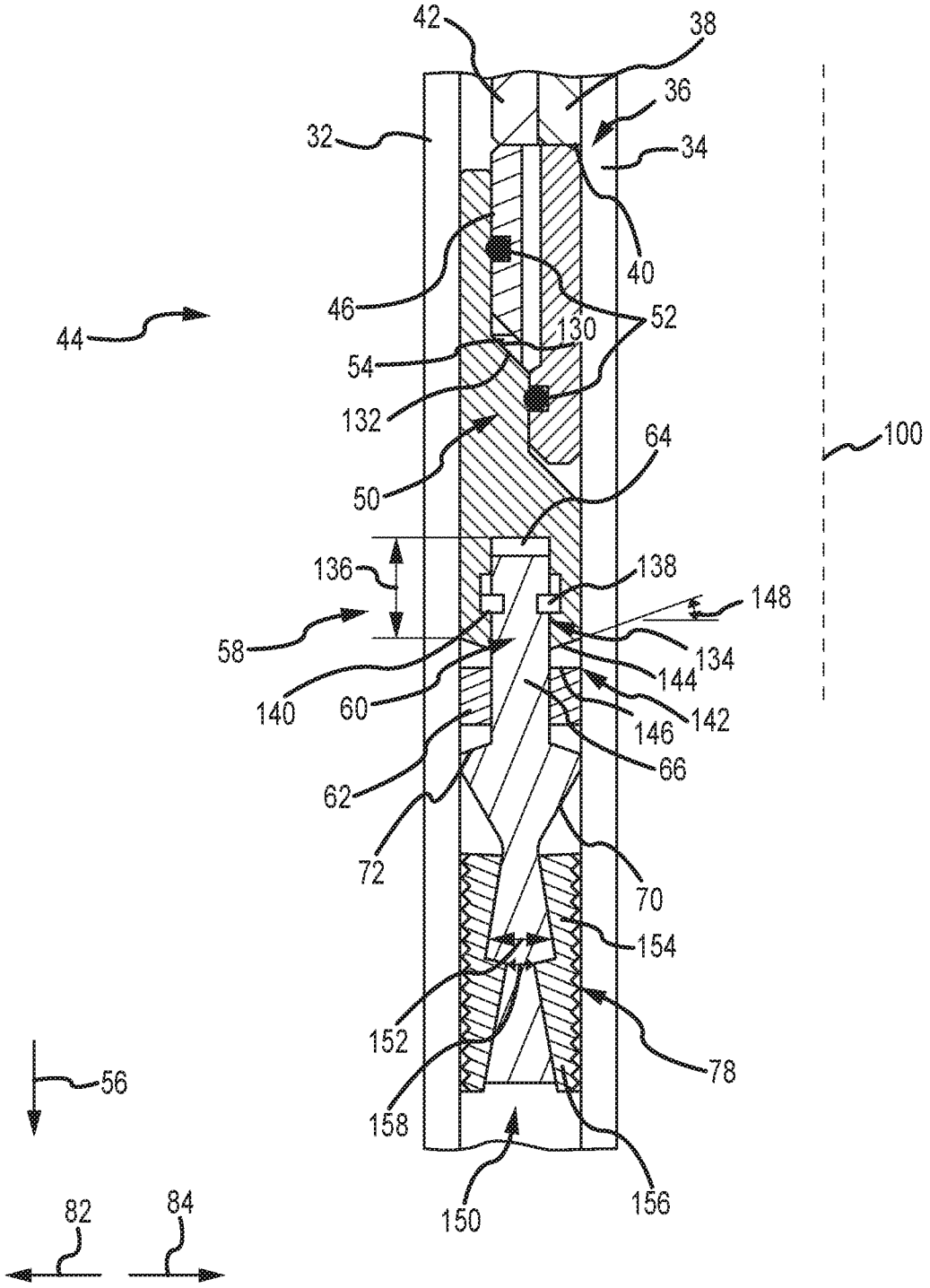
FIG. 5 is a partial detailed schematic cross-sectional view of an embodiment of a CBTDCS, in accordance with embodiments of the present disclosure.

FIG. 5 is a detailed partial schematic view of the activation system 44. As described above, the activation system 44 includes the upper nut 46, the actuating piston 50 and the actuating body 60. In the illustrated embodiment, each component of the activation system 44 may extend substantially circumferentially about the interior casing 34. As described above, the upper nut 46 may be coupled to one or both of the casing collar 38 and the hold down collar 42. As a result, axial movement of the upper nut 46 along the axis 100 is restricted. However, the actuating piston 50 may be free to move axially, at least to a certain extent, as the actuating piston 50 is stroked or driven in the downward direction 56. In the illustrated embodiment, the seals 52 provide separation between the upper nut 46 and the actuating piston 50. It should be appreciated that the seals 52 may block fluid from flowing out of the void space 54.

In the illustrated embodiment, both the upper nut 46 and the actuating piston 50 have respective corresponding profiles 130, 132. These profiles 130, 132 enable a mating fit between the upper nut 46 and the actuating piston 50, thereby enabling entry into the wellbore 16 within the annulus 36. Furthermore, the profiles 130, 132 provide a tortuous flow path in the event that fluids leak past the seals 52. That is, fluid leaking past the seals 52 may change directions multiple times, thereby reducing pressure and decreasing the force of the fluid. The profiles 130, 132 separate at the void space 54, which enables pressurized fluid to enter and drive the actuating body 60, via a stroke of the actuating piston 50, in the downward direction 56 to engage the slip elements 78.

The illustrated actuating piston 50 receives and supports the actuating body 60 within the slip carrier 58. As shown, the actuating piston 50 includes the opening 134 for holding the actuating body 60. As will be described below, a length 136 of the opening 134 is longer than the rear end 66 of the actuating body 60, thereby enabling axial movement of the actuating body 66 within the opening 134. The actuating body 60 is secured within the opening 134 by a retainer ring 138. The retainer ring extends radially outward from the rear end 66 of the actuating body 60 and blocks axial movement in the downward direction 56 when the retainer ring 138 contacts a shoulder 140 formed within the opening 134. In the illustrated embodiment, the retainer ring 138 rests on the shoulder 140, thereby forming the gap 64 within the opening 134. As described above, the gap 64 may be reduced or be filled with the rear end 66 of the actuating body 60 when the actuating piston 50 is driven in the downward direction 56.

FIG. 5 further includes the sealing element 62 positioned circumferentially about the actuating body 60 and within the annulus 36 between the inner diameter of the casing 32 and the outer diameter of the interior casing 34. In operation, the sealing element 62 is compressed between the actuating body 60 and the actuating piston 50, thereby forming a seal between the casing 32 and the interior casing 34. As described above, the actuating piston 50 includes a lower end 142 having an angled portion 144. The angled portion 144 is generally arranged to point downward toward the sealing element 62 and engages an upper portion 146 of the sealing element 62 when the sealing element 62 is compressed between the actuating piston 50 and the actuating body 60. The illustrated angled portion 144 includes the angles 148, which are acute angles in the illustrated embodiment. However, it should be appreciated that the angles may be obtuse in other embodiments. Further, in various embodiments, the lower portion 142 may be substantially flat, curved, or any other reasonable shape.

As described above, the actuating body 60 includes the front face 70 and the rear face 72. The rear face 72 includes a substantially angled surface at the angle 74. As shown, the shape of the rear face 72 is opposite the shape of the lower end 142. As a result, the two angled faces will drive into the sealing element 62 substantially near the center to thereby drive the sealing element 62 outward and into the interior casing 34 and the casing 32.

The slip elements 78 illustrated in FIG. 6 includes a double tapered wedge profile 150 arranged therebetween to allow the actuating body 60 to move in the downward direction 56 and between the respective components of the slip elements 78. As shown, the double tapered wedge profile 150 has a variable diameter 152. The variable diameter 152 is the result of an angled upper portion 154 and an angled lower portion 156. Accordingly, as the front face 70 of the actuating body 60 enters the double tapered wedge profile 150, the front face 70 contacts a reduced diameter portion 158 to thereby drive the slip elements 78 in the first and second radial directions 82, 84. The teeth 80 arranged on the slip elements 78 dig into the casing 32 and the interior casing 34 to secure the interior casing 34 in place within the wellbore 16. As a result, the interior casing 34 may be deployed and suspended from any location within the wellbore 16 without an initial suspension from the surface. In various embodiments, the teeth 80 may be in the form of concentric circles, which may be referred to as wickers. However, in other embodiments the teeth 80 may be triangular, helical, or the like.

FIG. 6 is a detailed partial schematic view of the slip elements 78 in the engaged position wherein the teeth 80 dig into the casing 32 and the interior casing 34. As shown, the actuating body 60 is arranged within the double tapered wedge profile 150 and drives the slip elements 78 in the first and second radial direction 82, 84. Accordingly, the interior casing 34 is suspended within the wellbore 16. In the illustrated embodiment, the respective profile 130, 132 of the upper nut 46 and the actuating piston 50 are separated upon axial movement of the actuating piston 50 along the axis 100 as the void space 54 fills with fluid. As shown, the gap 64 is almost or substantially filled by the rear end 66 of the actuating body 60 as the actuating piston 50 and actuating body 60 both move in the downward direction 56. As a result, the lower end 142 of the actuating piston 50 and the rear face 72 of the actuating body 60 compress the sealing element 62, thereby forming a seal within the annulus 36 between the casing 32 and the interior casing 34. Accordingly, the interior casing 34 is suspended within the wellbore 16. As described above, the interior casing 34 and the CBTDCS 30 may be removed from the wellbore 16 by pressurizing the void space 54 to a predetermined amount to rupture the relief component 90 arranged within the flow line 88. Thereafter, the CBTDCS 30 may be lifted from the wellbore 16.

Figure 7:
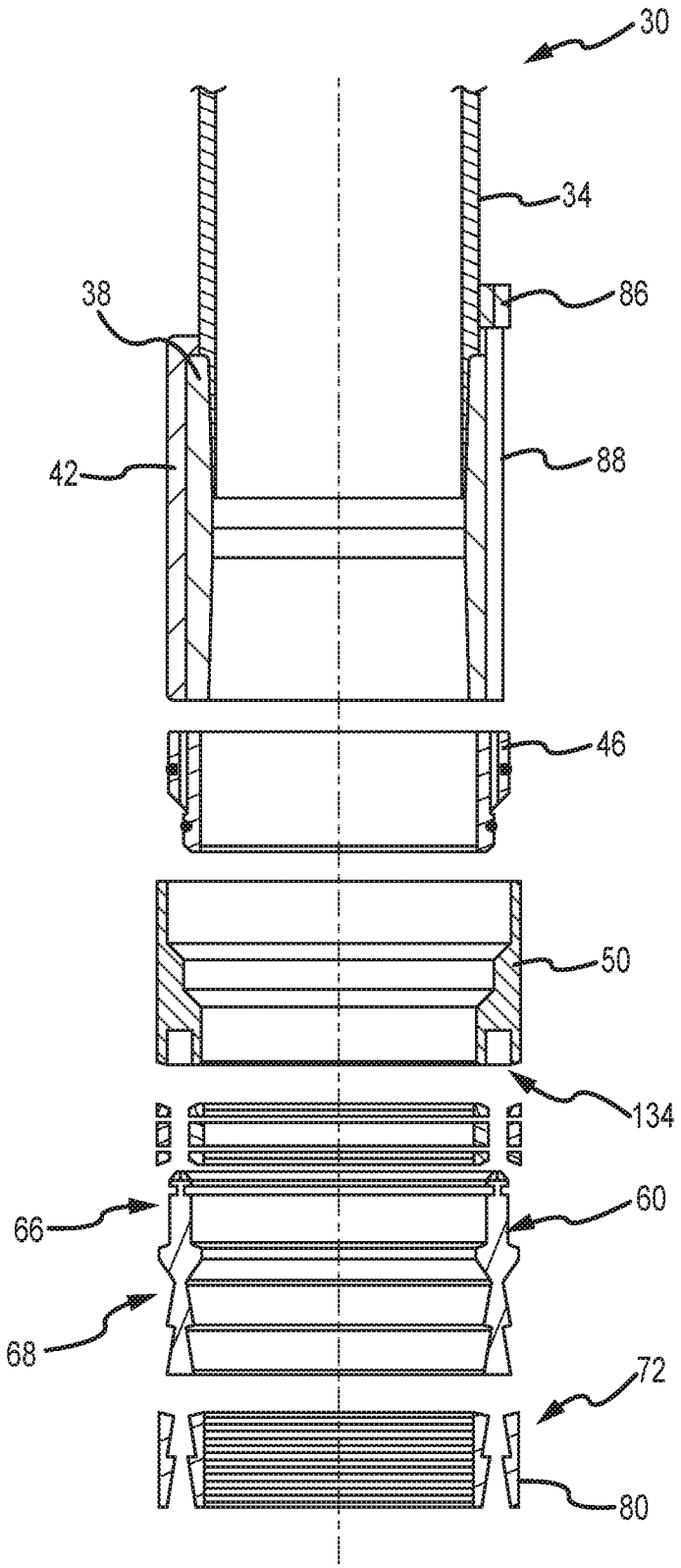
FIG. 7 is a schematic cross-sectional exploded view of an embodiment of a CBTDCS, in accordance with embodiments of the present disclosure.

FIG. 7 is a cross-sectional schematic exploded view of an embodiment of the CBTDCS 30. As described in detail above, the CBTDCS 30 includes the interior casings 34 that are coupled together at the coupling interface 110 via the casing collar 38 and the hold down collar 42. In the illustrated embodiment, the upper nut 46 is positioned within an area formed in the actuating piston 50. Upon entry of the fluid via the ports 48 in the upper nut 46, the actuating piston 50 may stroke in the downward direction 56 to activate the slip elements 78. The illustrated embodiment further includes the actuating body 60, which is installed within the opening 134 in the actuating piston 50 and may be secured within the opening via the retainer ring 138. The illustrated actuating body 60 includes the rear end 66 and the head end 68, which extends into the space between the slip elements 78 when energized. The illustrated embodiment further includes the slip elements 78 having the double tapered wedge profile 150. As described above, the slip elements 78 may be a singular piece or be split. In operation, certain components of the CBTDCS 30 may be coupled together at the surface before being positioned within the wellbore 16. For instance, the interior casings 34 may be secured together via the casing collar 38 and the hold down collar 42. Furthermore, the illustrated upper nut 46 and actuating piston 50 may be arranged proximate one another, and in certain embodiments may be secured together, for example via the anchor 114. The actuating body 60 may also be coupled to the actuating piston 50 and the slip elements 78 may be arranged along at least a portion of the interior casing 34. Accordingly, in various embodiments the CBTDCS 30 may be at least partially assembled at the surface before being installed within the wellbore 16.

Figure 8:
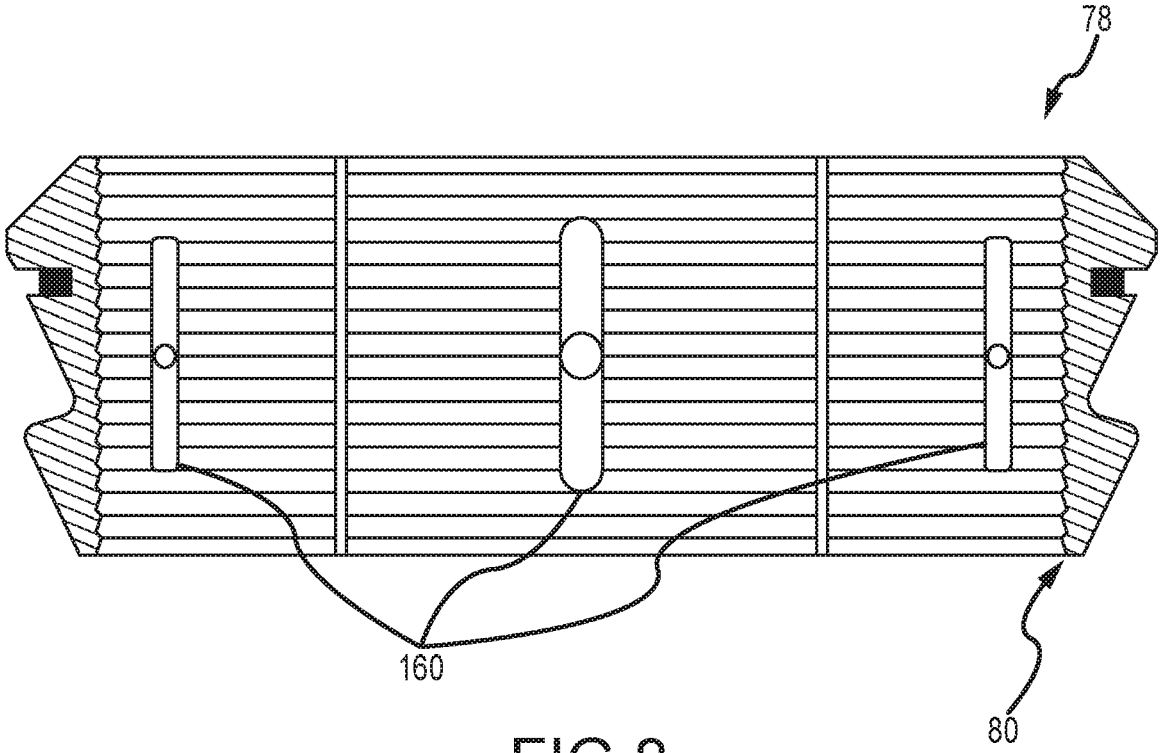
FIG. 8 is a partial detailed view of an embodiment of slip elements of a CBTDCS, in accordance with embodiments of the present disclosure.

FIG. 8 is a partial detailed view of an embodiment of the slip elements 78. As described above, the slip elements 78 include the teeth 80, which may be wickers, substantially triangular teeth, or the like. In the illustrated embodiment the teeth 80 project radially outward to thereby engage with the inner diameter of the casing 32. The illustrated slip elements 78 include a plurality of vertical slots 160, which enable vertical travel of the slip elements 78 along the interior casing 34. In various embodiments, the slip elements 78 are retained by fasteners extending through the slots 160, thereby preventing the slip elements 78 from falling into the well.

Figure 9:
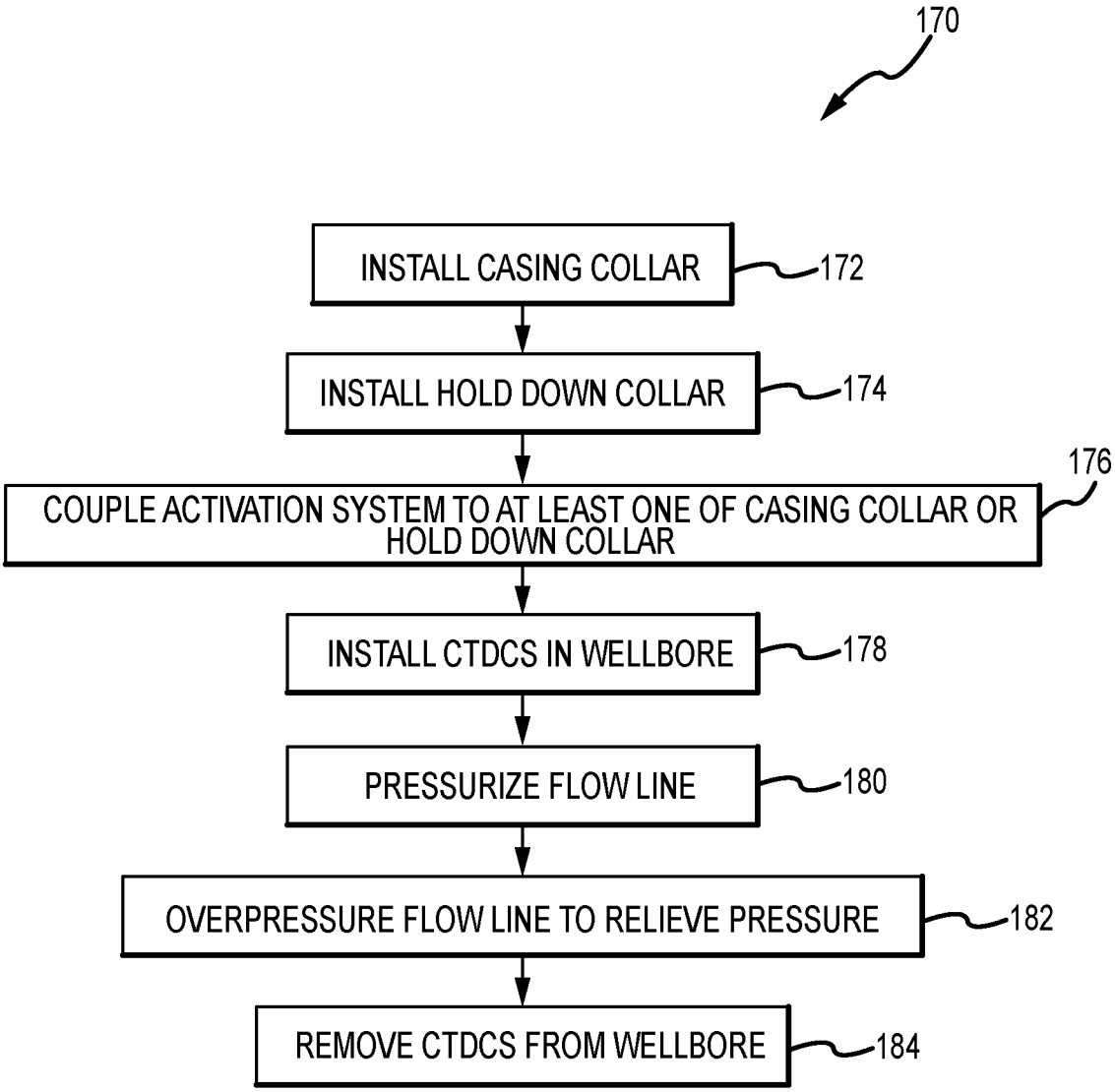
FIG. 9 is a flow chart of an embodiment of a method for installing a CBTDCS, in accordance with embodiments of the present disclosure.

FIG. 9 is a flow chart of an embodiment of a method 170 for installing the CBTDCS 30. As described above, systems and methods of the present embodiments may be utilized to support tubulars within wellbores. In an embodiment, the casing collar 38 is installed (block 172) to couple two tubulars together, such as sections of interior casing 34. Then, the hold down collar 42 is installed (block 174) to secure the casing collar 38. As described above, in various embodiments the casing collar 38 and/or the hold down collar 42 may be coupled to additional components and also work with additional components of the CBTDCS 30. Next, the activation system 44 may be coupled to at least one of the casing collar 38 and the hold down collar 42 (block 176). For example, the anchor 114 and one or more fasteners may be utilized to couple the upper nut 46 to one or more of the hold down collar 42 or the casing collar 38. Furthermore, in various embodiments, the flow line 88 may be used to at least partially couple the upper nut 46 of the activation system 44 to at least one of the hold down collar 42 and the casing collar 38. Next, the CBTDCS 30 may be lowered into the wellbore 16 (block 178). In various embodiments, the CBTDCS 30 is deployed within the wellbore 16 including casing 32 to thereby provide a substantially uniform surface for activation of the slip elements 78. The CBTDCS 30 enables the interior casing 34 to be positioned and suspended from any reasonable location within the wellbore 16. Upon positioning the CBTDCS 30 in the desired location (e.g., a predetermined location) the flow line 88 is pressurized with fluid (block 180). In various embodiments, pressurization of the flow line 88 is enabled by closing a BOP at the surface and directing fluid into the annulus 36. As described above, the flow line 88 may be coupled to a valve 86, which may be a one-way valve, that enables flow from the annulus 36 into the flow line 88. As a result, flow line 88 directs the fluid into the void space 54 via the upper nut 46, which drives axial movement of the actuating piston 50 along the axis 100. Movement of the actuating piston 50 is translated to the actuating body 60, which activates the slip elements 78 to support the interior casing 34 within the wellbore 16. At completion, the flow line 88 is overpressured, to a predetermined pressure level, to activate the relief component 90 (block 182). As a result, the fluid within the void space 54 flows out of the flow line 88 and into the annulus 36. Without the fluidic pressure, the actuating body 60 may have a reduced impact on the slip elements 78, thereby enabling removal of the CBTDCS 30. Thereafter, the CBTDCS 30 is removed from the wellbore 16 (block 184). For example, a force in an upward direction (e.g., opposite the downward direction 56) may disengage the slip elements 78 from the casing 32 and the interior casing 34 to enable removal of the CBTDCS 30.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A system for positioning wellbore tubulars within a wellbore, the system comprising:

a pair of wellbore tubulars coupled together via a casing collar, the pair of wellbore tubulars having a longitudinal axis substantially aligned with a wellbore axis;

a hold down collar arranged circumferentially about the casing collar, the hold down collar securing the casing collar to the pair of wellbore tubulars;

an actuating piston including an actuating body, the actuating piston being axially movable along the wellbore axis between an activated position and a deactivated position, the actuating body moving along with the actuating piston; and slip elements arranged downhole of the actuating piston, the slip elements receiving the actuating body in a space formed between the slip elements, wherein the actuating body drives the respective slip elements in opposite radial directions when in the activated position to secure the pair of wellbore tubulars within the wellbore.

2. The system of claim 1, further comprising a sealing element arranged circumferentially along at least a portion of a length of the actuating body, wherein a lower end of the actuating piston and a rear face of the actuating body compress the sealing element from opposite sides of the sealing element when in the activated position.

3. The system of claim 1, further comprising an upper nut positioned proximate the actuating piston, the upper nut abutting a shoulder of the casing collar and comprising a port for directing a fluid through the upper nut and into a void space between the upper nut and the actuating piston.

4. The system of claim 1, further comprising a one way valve coupled to a flow line, the one way valve enabling fluid to move the actuating piston from the deactivated position to the activated position.

5. The system of claim 1, further comprising casing arranged along an inner diameter of the wellbore, the casing and the pair of wellbore tubulars forming an annulus therebetween, and wherein the slip elements comprising teeth that extend into at least one of the casing and the pair of wellbore tubulars to suspend the pair of wellbore tubulars within the wellbore.

6. The system of claim 5, wherein the casing collar, the hold down collar, the slip elements, and the actuating piston are arranged within the annulus radially outward from an outer diameter of the pair of wellbore tubulars.

7. A system for hanging a casing tubular within a wellbore, the system comprising:

a first segment of casing tubular;

a second segment of casing tubular, the second segment coupled to the first segment via a casing collar;

a hold down collar arranged circumferentially about the casing collar and securing the first segment to the second segment, the hold down collar extending radially outward from the first and second segments;

an upper nut abutting a lower shoulder formed by the casing collar and being coupled to at least one of the casing collar and the hold down collar;

an actuating piston positioned proximate of the upper nut, wherein at least a portion of the actuating piston is radially outward of the upper nut, and the actuating piston is moveable along a longitudinal axis of the wellbore relative to the upper nut;

an actuating body positioned within an opening in the actuating piston, wherein the actuating body is coupled to the actuating piston such that movement of the actuating piston is transferred to the actuating body; and slip elements positioned downhole of the actuating piston, wherein movement of the actuating piston transitions the slip elements from a deactivated position to an activated position where the slip elements move radially from one another in opposite directions.

8. The system of claim 7, wherein the actuating body is driven into a space between the slip elements when the actuating piston moves in a downward direction, the space formed between a double tapered wedge profile of the slip elements.

9. The system of claim 7, further comprising a gap between an interior face of the opening and a rear end of the actuating body, the gap being closed when the actuating piston moves in the downward direction.

10. The system of claim 9, further comprising a sealing element arranged circumferentially about at least a portion of the rear end of the actuating body and between a lower end of the actuating piston and a rear face of the actuating body.

11. The system of claim 7, further comprising a sealing element between a lower end of the actuating piston and a rear face of the actuating body, wherein the lower end of the actuating piston has an angled surface and the rear face of the actuating body has an angled surface, the respective angled surfaces being angled in opposite directions.

12. The system of claim 7, wherein the slip elements comprise teeth on respective outer portions of the slip elements, wherein the teeth dig into a casing arranged along an inner diameter of the wellbore and into an outer diameter of the second tubing segment when the actuating piston is in the activated position.

13. The system of claim 7, further comprising a void space between the upper nut and the actuating piston, the void space being fluidly coupled to a flow line extending through the upper nut and receiving fluid from an annulus of the wellbore, wherein a pressure exerted by the fluid causes the actuating piston to move in a downward direction and into the activated position.

14. The system of claim 13, further comprising a one way valve arranged in the flow line, the one way valve blocking fluid from exiting the void space until a predetermined condition is reached.

* * * * *